US009057189B2

(12) United States Patent
Flury

(10) Patent No.: US 9,057,189 B2
(45) Date of Patent: Jun. 16, 2015

(54) RECTRACTABLE SCREEN SYSTEMS AND METHODS FOR CATCH BASINS

(71) Applicant: Terry Allen Flury, Long Beach, CA (US)

(72) Inventor: Terry Allen Flury, Long Beach, CA (US)

( * ) Notice: Subject to any disclaimer, the term of this patent is extended or adjusted under 35 U.S.C. 154(b) by 0 days.

(21) Appl. No.: 13/998,157

(22) Filed: Oct. 8, 2013

(65) Prior Publication Data

US 2014/0097133 A1 Apr. 10, 2014

Related U.S. Application Data

(60) Provisional application No. 61/744,980, filed on Oct. 9, 2012.

(51) Int. Cl.

| | |
|---|---|
| ***E03F 5/14*** | (2006.01) |
| ***E03F 5/046*** | (2006.01) |
| *E03F 5/04* | (2006.01) |

(52) U.S. Cl.

CPC . *E03F 5/14* (2013.01); *E03F 5/046* (2013.01); *E03F 5/0404* (2013.01)

(58) Field of Classification Search

None

See application file for complete search history.

(56) References Cited

U.S. PATENT DOCUMENTS

| | | | | |
|---|---|---|---|---|
| 6,869,523 | B2 | 3/2005 | Martinez | |
| 6,972,088 | B2 | 12/2005 | Yehuda | |
| 7,234,894 | B1 | 6/2007 | Flury | |
| 7,238,279 | B2 | 7/2007 | Saurenman et al. | |
| 7,467,911 | B2 * | 12/2008 | Flury | 405/94 |
| 7,491,338 | B2 | 2/2009 | Nino | |
| 7,951,291 | B2 * | 5/2011 | Nino | 210/131 |
| 8,017,006 | B2 * | 9/2011 | Lopez | 210/163 |
| 8,277,645 | B2 | 10/2012 | Jarvis, Jr. et al. | |
| 8,535,523 | B2 * | 9/2013 | Friezner et al. | 210/156 |
| 8,945,375 | B2 * | 2/2015 | Friezner et al. | 210/131 |
| 2004/0173513 | A1 * | 9/2004 | Nino | 210/156 |
| 2008/0014021 | A1 * | 1/2008 | Flury | 405/94 |
| 2008/0226390 | A1 * | 9/2008 | Nino | 404/5 |
| 2009/0120855 | A1 * | 5/2009 | Flury | 210/137 |
| 2009/0236293 | A1 * | 9/2009 | Alvarado | 210/747 |
| 2010/0147752 | A1 * | 6/2010 | Jarvis et al. | 210/123 |
| 2012/0103883 | A1 | 5/2012 | Friezner et al. | |
| 2014/0041744 | A1 * | 2/2014 | Friezner et al. | 138/39 |
| 2014/0097133 | A1 * | 4/2014 | Flury | 210/170.03 |
| 2015/0053598 | A1 * | 2/2015 | Friezner et al. | 210/156 |

* cited by examiner

*Primary Examiner* — Robert James Popovics

(57) ABSTRACT

Retractable screen systems and methods for catch basins are disclosed. In an example embodiment, a retractable screen apparatus includes a retractable center screen coupled to a retracting spring-loaded tube assembly secured to a portion of the catch basin. Two independently-operating side screens may each be coupled to the retractable center screen. Each side screen may be spring loaded such that each side screen is capable of opening and closing horizontally based on a predetermined fluid flow rate of water flowing into the catch basin.

9 Claims, 18 Drawing Sheets

RECTRACTABLE SCREEN SYSTEMS AND METHODS FOR CATCH BASINS

CLAIM OF PRIORITY

This application claims a priority benefit of U.S. Provisional Application Ser. No. 61/744,980, entitled, "Retractable-Screen Systems and Methods for Curb-Opening Storm Drain Catch Basins," filed Oct. 9, 2012, the disclosure of which is incorporated by reference herein in its entirety.

TECHNICAL FIELD

The present disclosure relates generally to storm drain catch basins, and more specifically to retractable screen systems and methods for catch basins.

BACKGROUND

Typical curbed storm drain catch basins are designed as a primary entry point for urban water runoff. The curb openings provide nuisance water, low flow storm water, and high flow storm water into the catch basin as well as trash and/or debris that emanates from the streets and curbsides.

Trash and/or debris such as bottles, cans, plastic wrappers, leaves, grass cuttings, sediments, manure, hydrocarbons, and other pollutants frequently find their way into these catch basins and may travel through storm drain outlet pipes and into rivers, lakes, oceans, and other bodies of water.

A vast majority of screened covers that have been inserted into curb opening catch basins stay closed during the dry season and swing open through mechanical trip devices when the storm water reaches a predetermined curb height.

During heavy rainfall events, due to storms or water main pipeline breakage, it is imperative that water flow from the streets into the curb openings containing these retractable screens open up significantly in order to prevent street flooding.

Trash and/or debris accumulate in front of these screened devices and along the curbs and gutters from the streets. Street sweeper trucks often provide cleaning service to remove and collect this debris build-up during planned maintenance schedules, which can be performed periodically (e.g., weekly, monthly, etc.). The screened devices that have debris build-up will typically remain closed during the street sweeper brush pass, as well as stay closed during nuisance water and low flow storm water events.

Typical storm drain screened gate systems designed to remain closed during the dry season or low flow storm water events and open during heavy storm water events are disclosed in, for example, U.S. Pat. No. 7,491,338 to Nino, U.S. Pat. No. 6,869,523 to Martinez, U.S. Pat. No. 8,277,645 to Jarvis, U.S. Pat. No. 7,234,894 to Flury, U.S. Pat. No. 6,972,088 to Yehuda, U.S. Patent Publication No. 2012/0103883 to Friezner, and U.S. Pat. No. 7,238,279 to Saurenman. The disadvantage of such systems is that some of these screen devices incorporate locking pin components, which can malfunction due to trash and/or debris fouling, which prevent opening of the screen device. Additionally, some devices may be too complex in design, with many moving parts that can prevent opening and/or closing due to trash and/or debris entanglement.

BRIEF DESCRIPTION OF DRAWINGS

The present disclosure is illustrated by way of example and not limitation in the figures of the accompanying drawings, in which like reference numerals indicate similar elements and in which will become better understood with regard to the following description, appended claims, and accompanying figures wherein:

DETAILED DESCRIPTION

In the following detailed description, numerous specific details are set forth to provide a thorough understanding of claimed subject matter. However, it will be understood by those skilled in the art that claimed subject matter may be practiced without these specific details. In other instances, methods, apparatuses, or systems that would be known by one of ordinary skill have not been described in detail so as not to obscure the claimed subject matter.

In the following detailed description, the terms "left" and "right" are intended to indicate such directions as viewed from the upstream side of the curb-view from the street. The terms "vertical" and "horizontal" are intended to include directions that are substantially vertical and substantially horizontal, respectively.

The present disclosure relates to retractable screen systems, apparatuses, and/or devices that include mechanical components allowing the retractable screen system, apparatus, and/or device to be in various positions. For example, the retractable screen system may be in a closed, unlocked position, which may prevent street sweeping trucks from pushing trash, debris, and/or litter into, through, and/or past the screened system into the catch basin that may lead into a storm drain system. In another example, the retractable screen system may open to a predetermined level based on a water level (e.g., during storm water curb flow).

In some embodiments, the retractable screen system may operate in a horizontal manner (e.g., as opposed to a vertical manner). For example, a winged screen affixed to both sides of a center screen on the retractable screen system may open horizontally toward the inside of a curb opening.

The present technology described herein provides the ability to prevent street flooding and clogging of the front of the retractable screen system due to the multiple screen openings of the retractable screen system. The retractable screen system may provide storm water flow opening of a hinged, spring loaded, winged screen on both ends of a central screen, where the winged screens may open horizontally into the storm drain catch basin (e.g., during storm water flow overriding the spring pressure of the screen openings). In some embodiments, the present technology may avoid using locking and unlocking devices, while preventing trash and debris from bypassing the winged screens. In other embodiments, locking and unlocking devices may be used.

Figure 1:
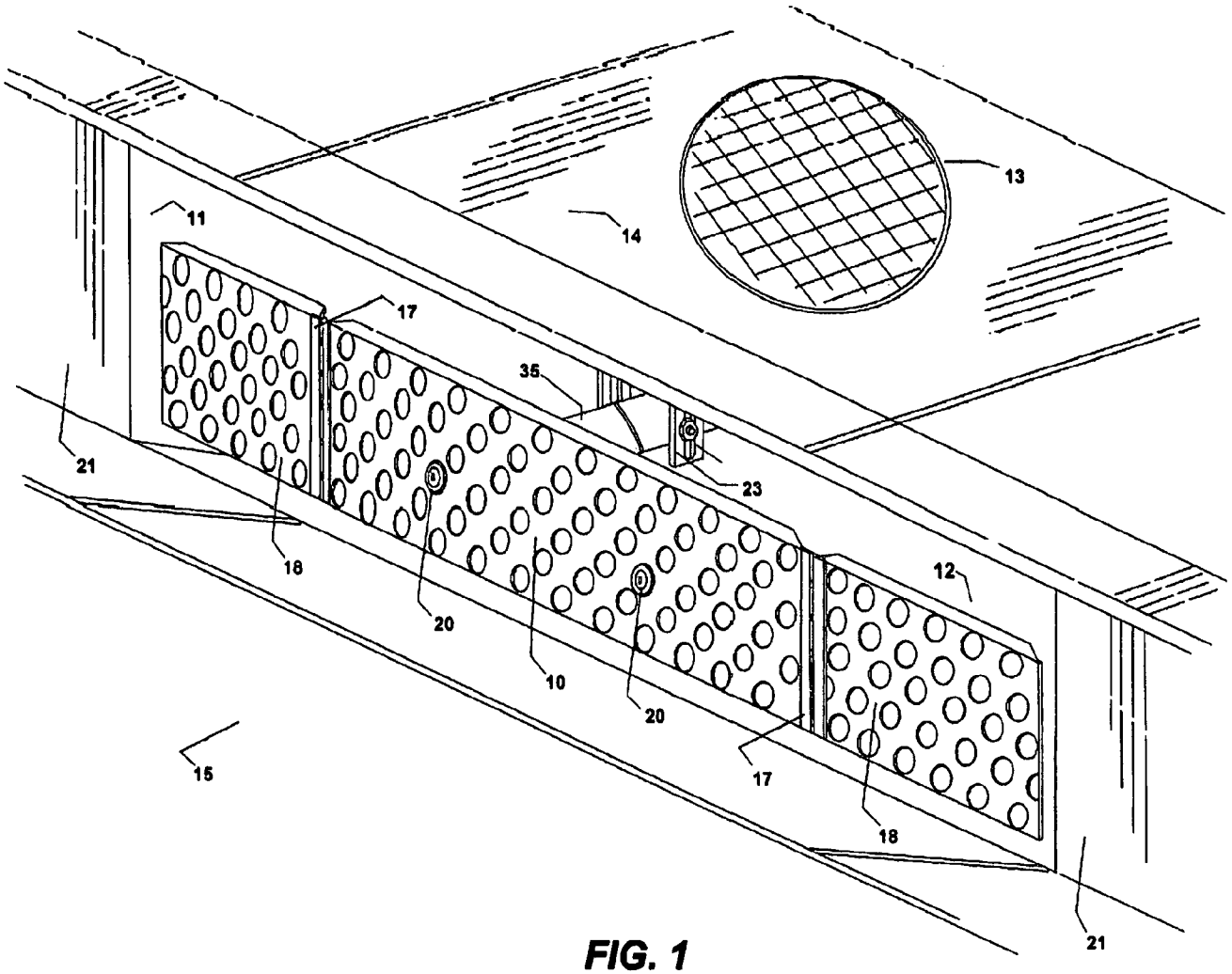
FIG. 1 is a schematic diagram depicting an example curb-opening retractable screen system installed across a curb opening storm drain catch basin, according to some embodiments.
Figure 2:
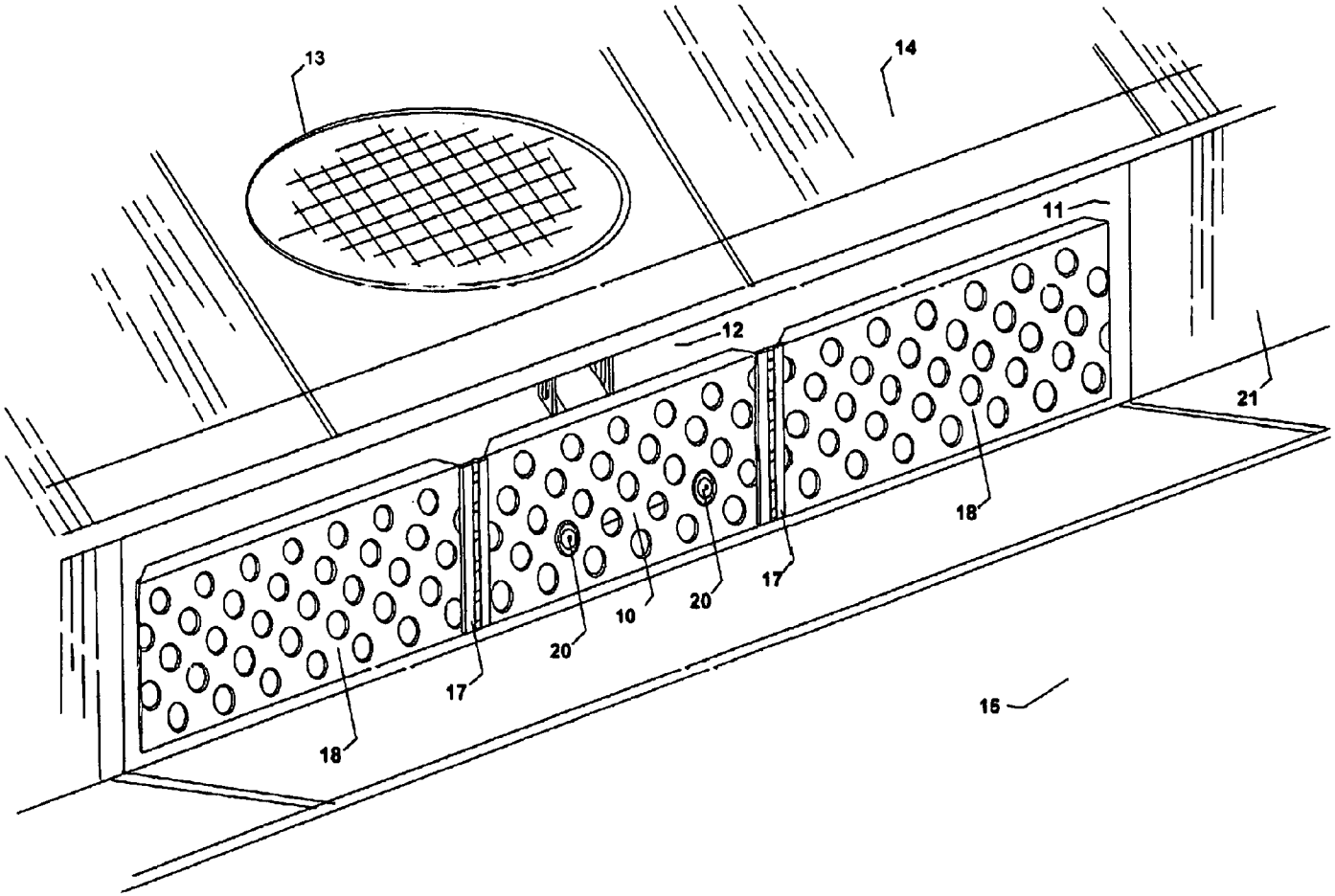
FIG. 2 is a schematic diagram depicting the example curb-opening retractable screen system from the front left side perspective, according to some embodiments.

FIG. 1 is a schematic diagram depicting an example curb-opening retractable screen system installed across a curb opening storm drain catch basin 12. FIG. 2 is a schematic diagram depicting the example curb-opening retractable screen system from the front left side perspective. The screen system may be installed for the catch basin 12 across a curb opening 11 of the curb 21 on a street 15. The catch basin 12 may be accessed using a manhole 13 in the sidewalk 14. A winged screen 18 may be connected to both sides of a center screen 10 (e.g., by weld) using piano hinge 17 (e.g., ⅜" tube), which may allow the winged screens 18 to open into the curb opening 11 in a horizontal manner. Screen mounting bracket 37 (shown in FIG. 15) is secured to center screen 10 using component 20, which may be any suitable component for affixing compression tube 35 to center screen 10, such as any one or combination of a cap screw (e.g., ⅜"×¾"), nut, flat washer, lock washer, and the like. The compression tube 35 may mount to screen mounting bracket 37. Component 23 may mount to the ceiling of the catch basin 12 to secure the screen system.

Figure 3:
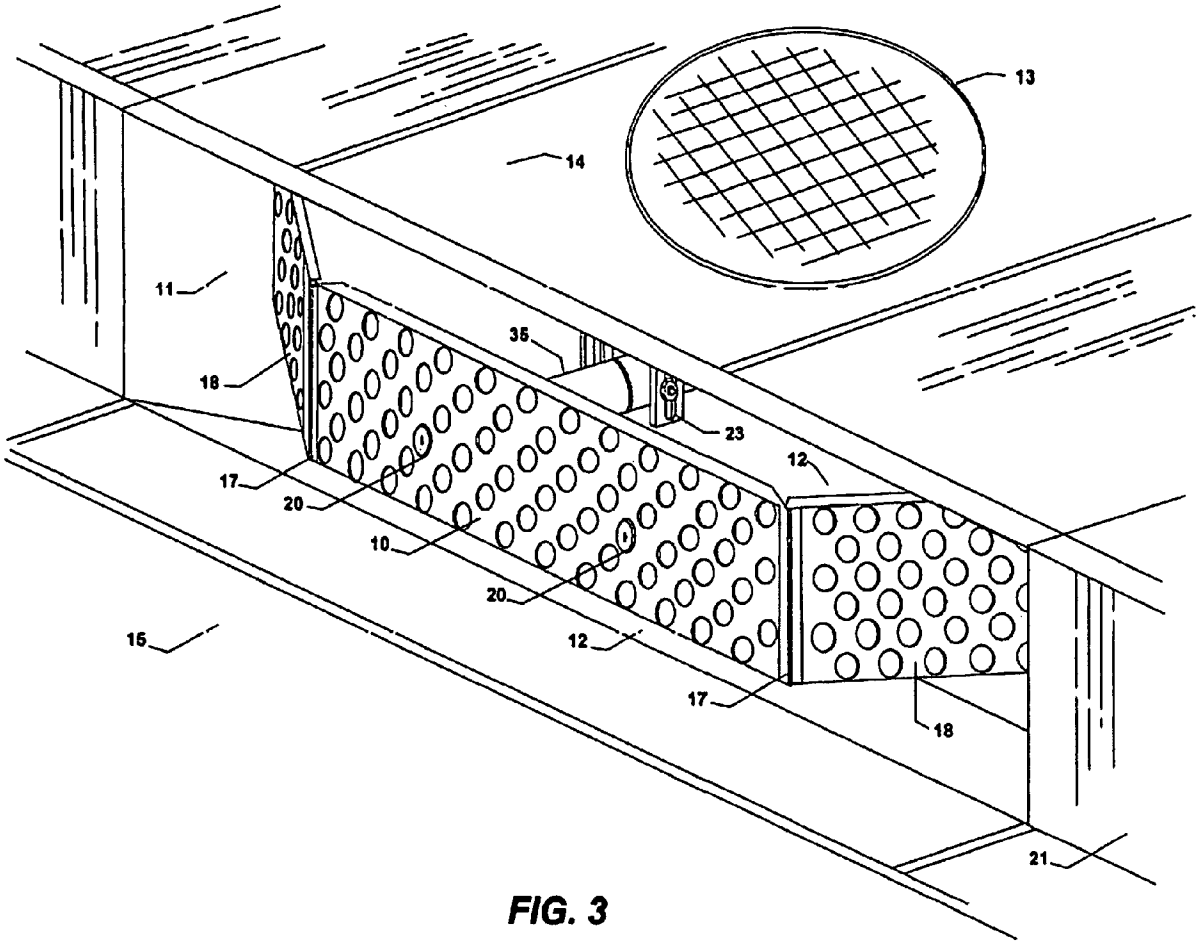
FIG. 3 is a schematic diagram depicting the example curb-opening retractable screen system from the front right perspective, according to some embodiments.
Figure 4:
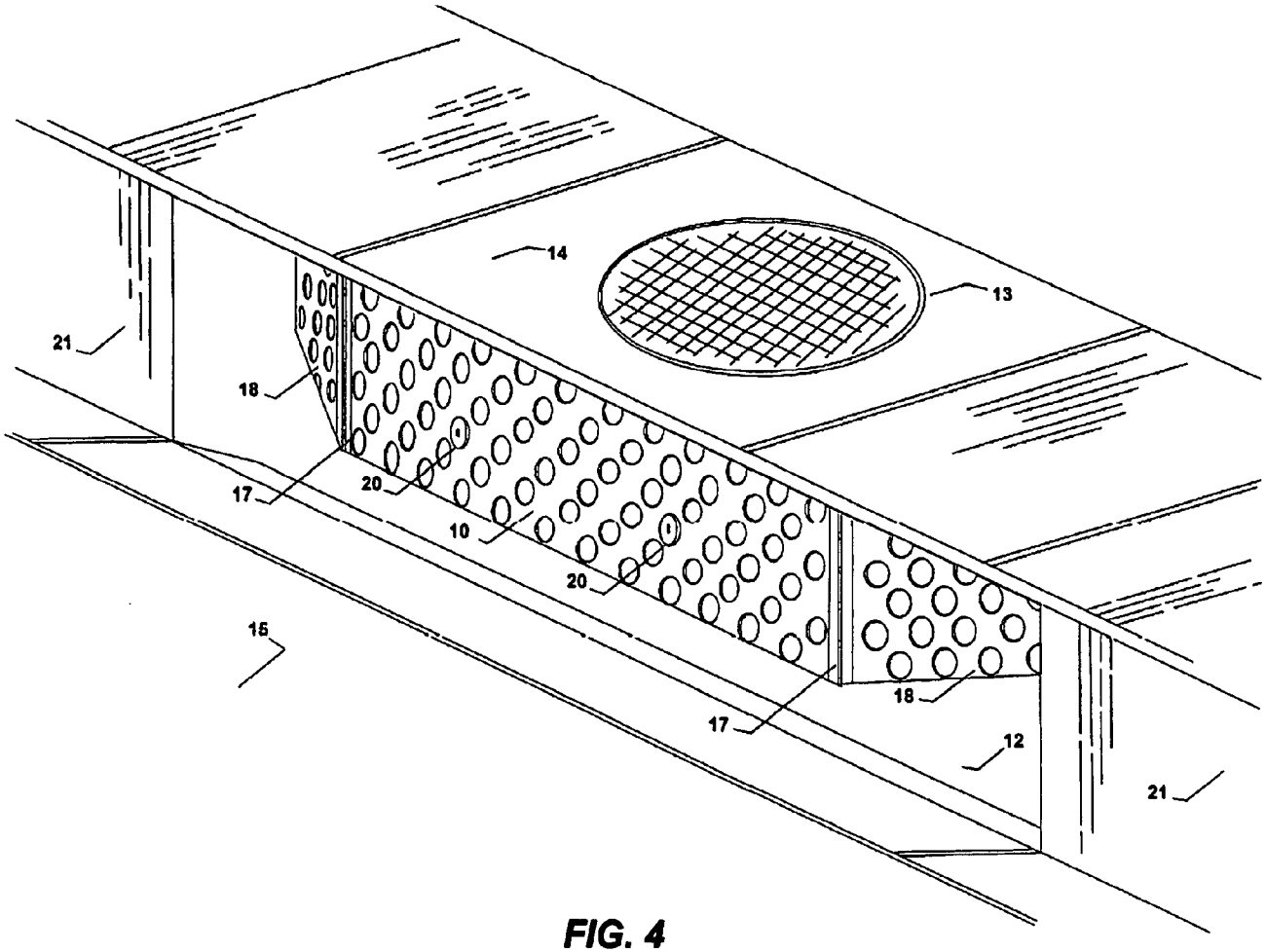
FIG. 4 is a schematic diagram depicting another example curb-opening retractable screen system from the front right perspective, according to some embodiments.

FIG. 3 is a schematic diagram depicting the example curb-opening retractable screen system from the front right perspective. FIG. 4 is a schematic diagram depicting another example curb-opening retractable screen system from the front right perspective. FIGS. 3 and 4 show embodiments of the winged screens 18 in an open position (e.g., horizontally open) while the center screen 10 remains unopened. Since storm water curb flow is typically flow directional, this technology allows curbed water to flow into either the right or left winged screens 18.

Figure 5:
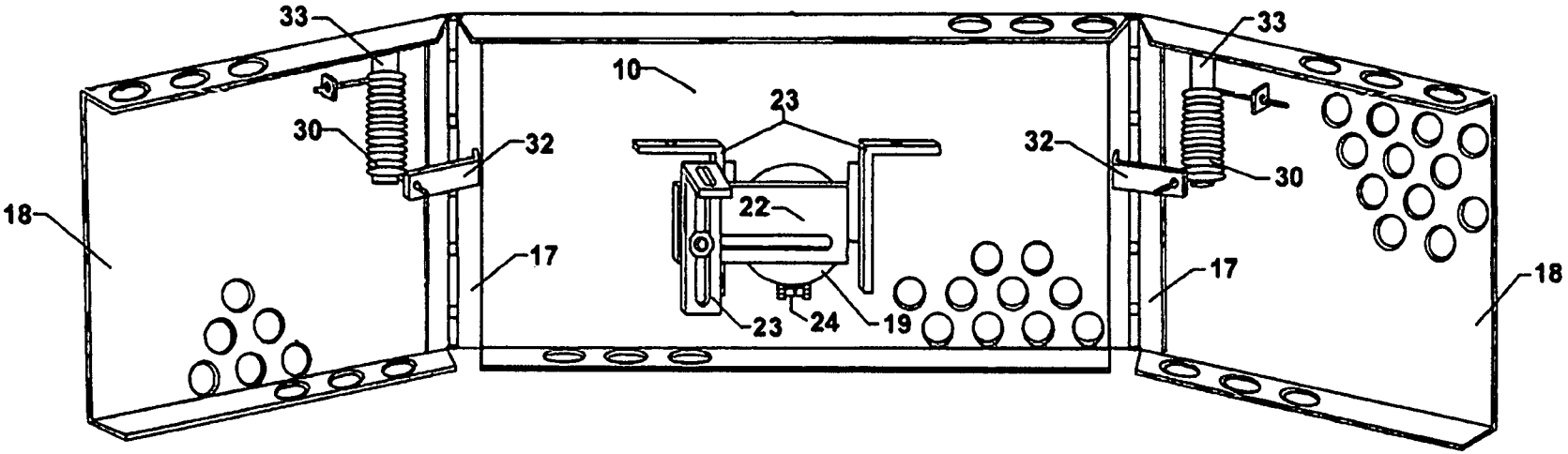
FIG. 5 is a schematic diagram depicting the example curb-opening retractable screen system from the rear view with the winged screens in an open position, according to some embodiments.
Figure 6:
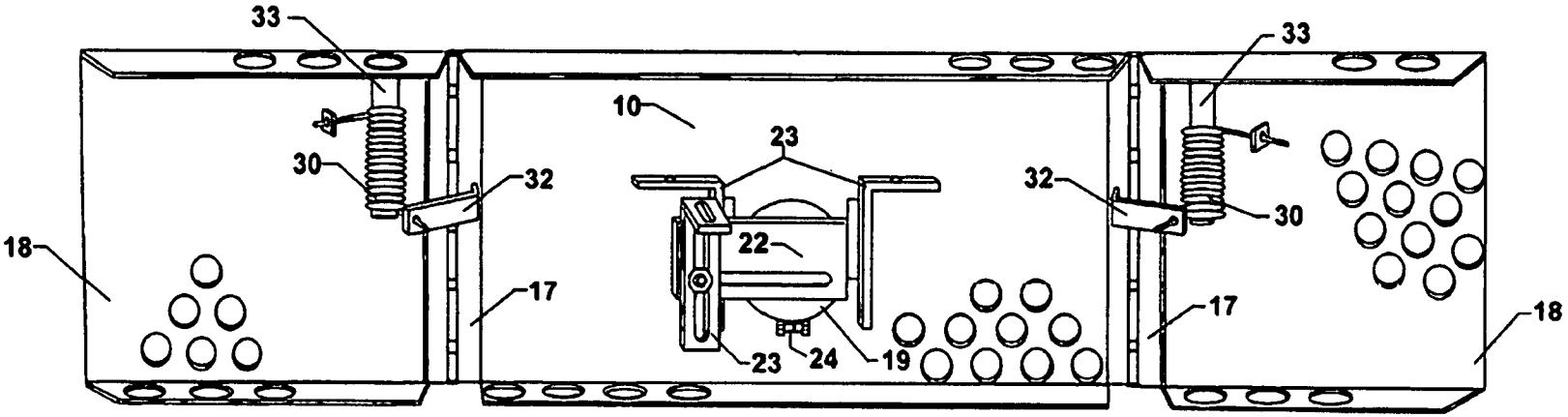
FIG. 6 is a schematic diagram depicting the example curb-opening retractable screen system from the rear view with the winged screens in a closed position, according to some embodiments.

FIG. 5 is a schematic diagram depicting the example curb-opening retractable screen system from the rear view with the winged screens 18 in an open position. FIG. 6 is a schematic diagram depicting the example curb-opening retractable screen system from the rear view with the winged screens 18 in a closed position. Mounted (e.g., by weld) on the top lip area of the winged screens 18 is a tube 33 of an appropriate size (e.g., ¾"×3") that has a tension spring 30 mounted over the tube 33 in which one end of the spring 30 is placed to rest by tension against the winged screen 18, and the other end of the spring 30 is placed to rest by tension through a hole in spring holder 32 secured (e.g., by weld) to the center screen 10.

Figure 7:
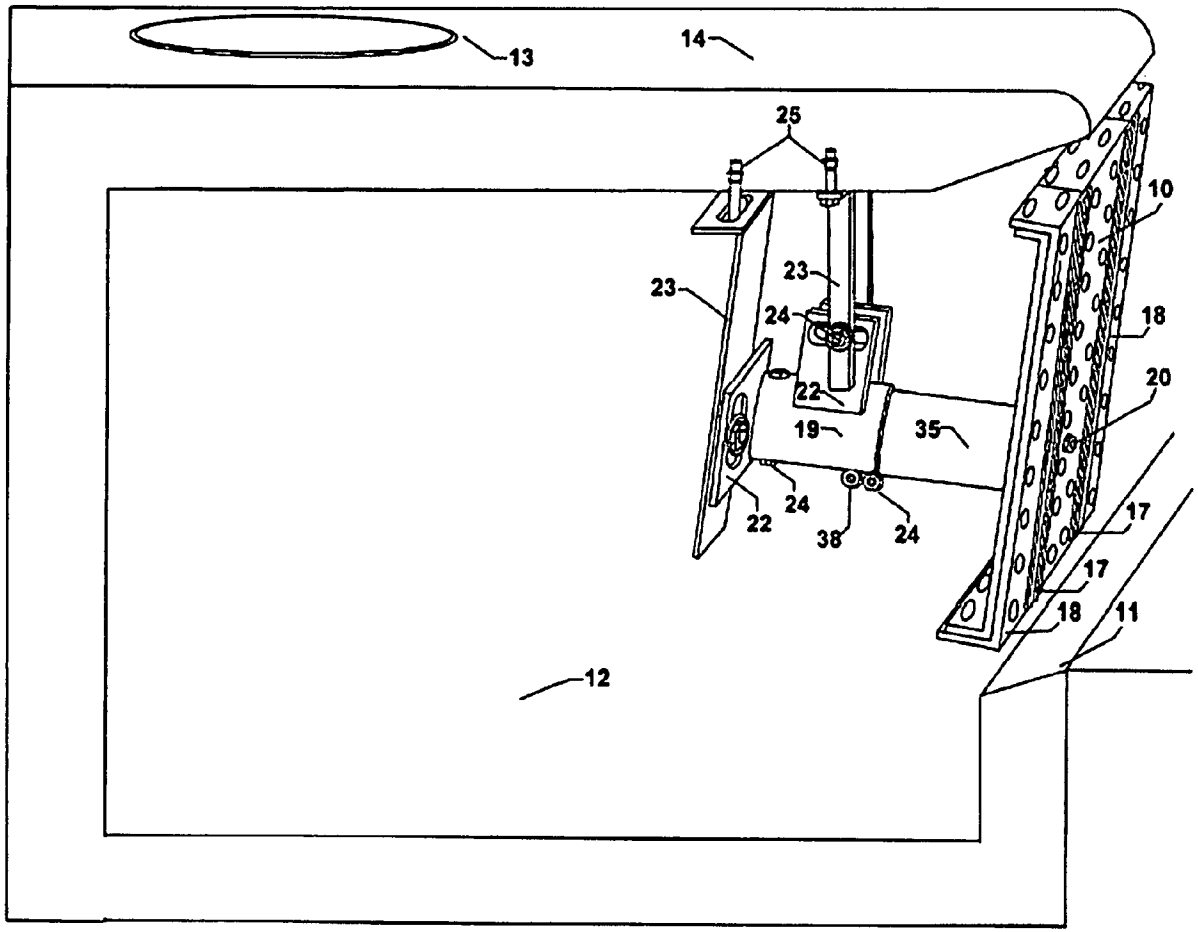
FIG. 7 is a schematic diagram depicting the example curb-opening retractable screen system from the left side view with the winged screens in a closed position, according to some embodiments.
Figure 8:
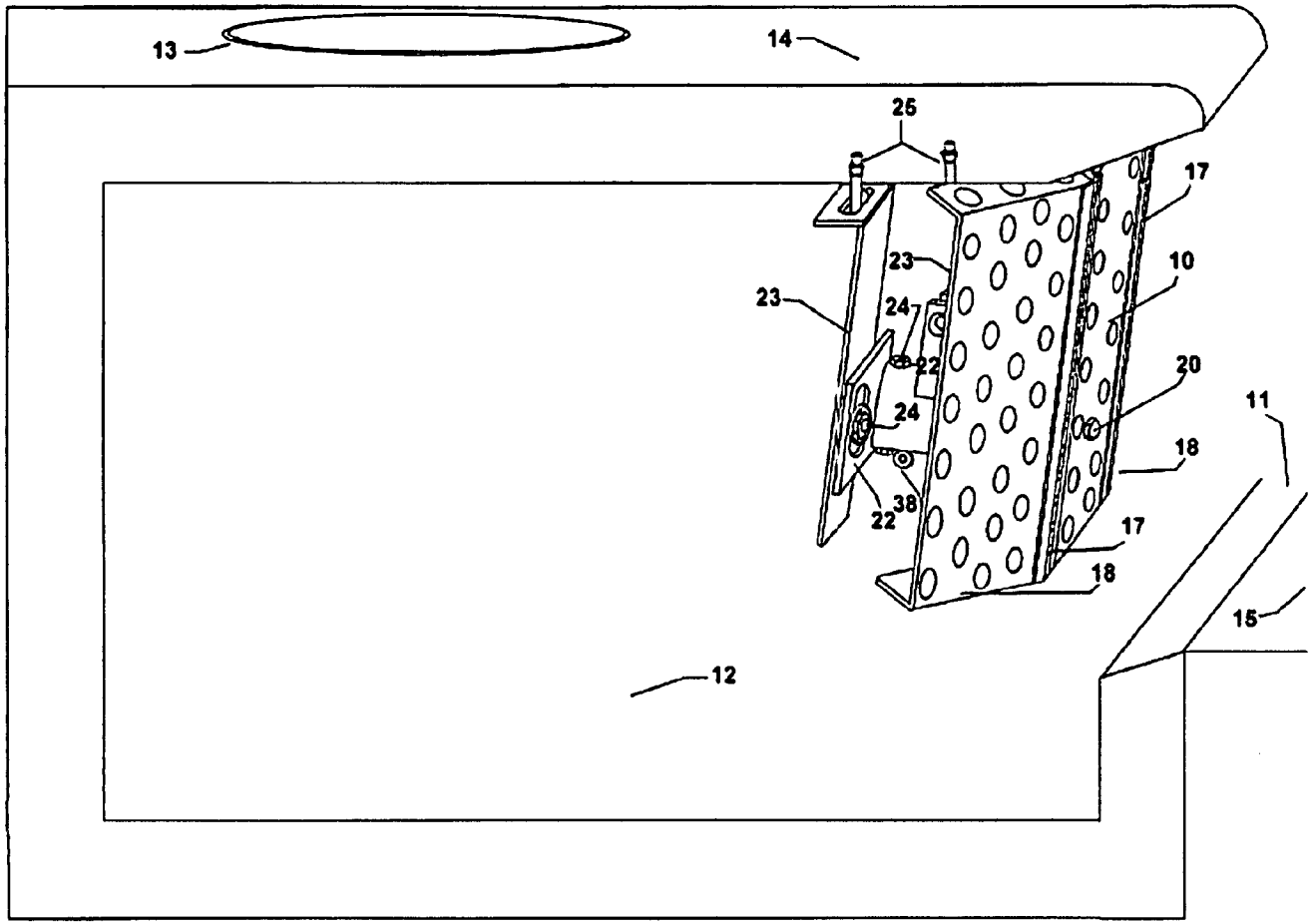
FIG. 8 is a schematic diagram depicting the example curb-opening retractable screen system from the left side view with the winged screens in an open position, according to some embodiments.
Figure 9:
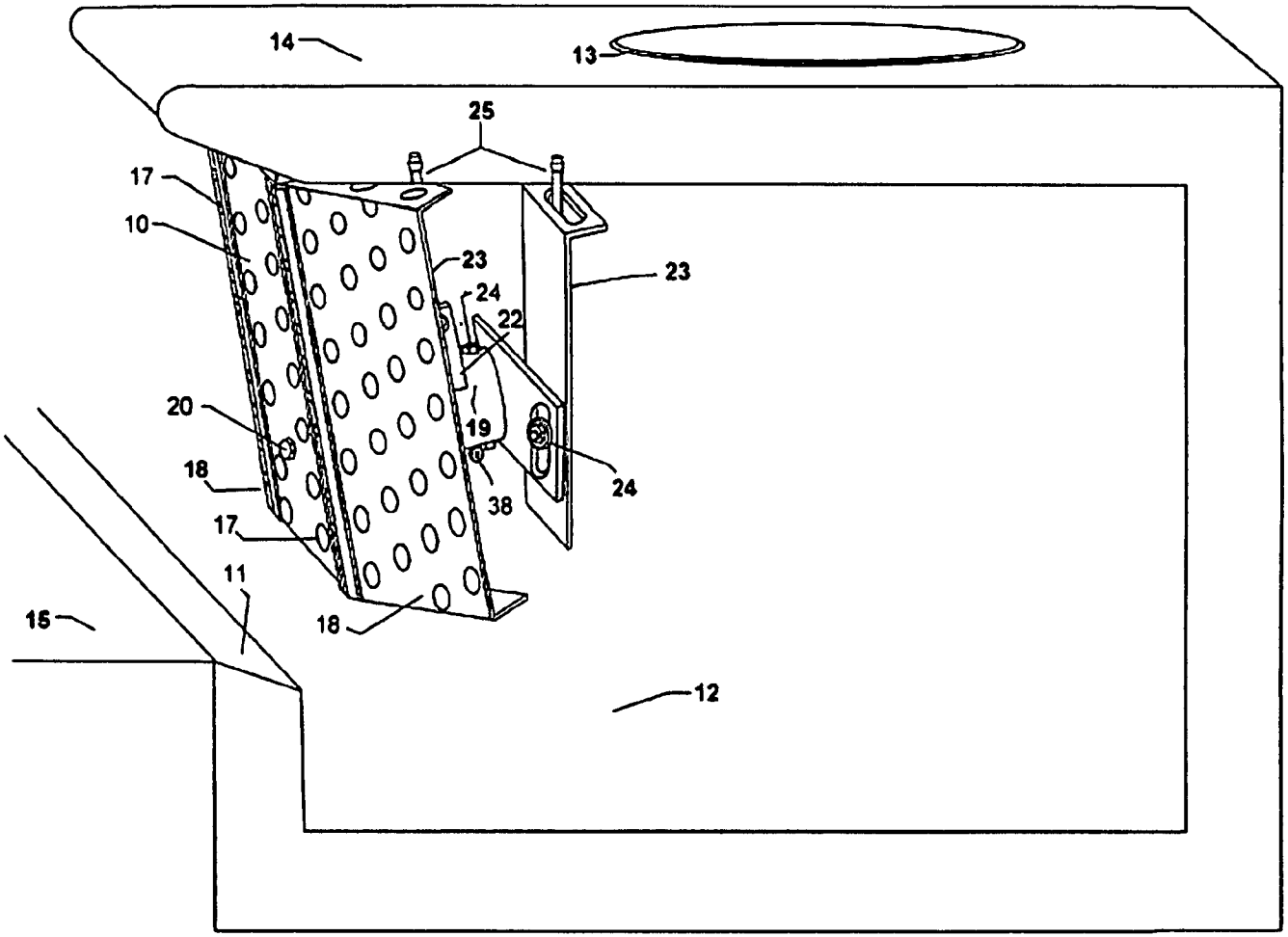
FIG. 9 is a schematic diagram depicting the example curb-opening retractable screen system from the right side view with the winged screens in an open position, according to some embodiments.
Figure 10:
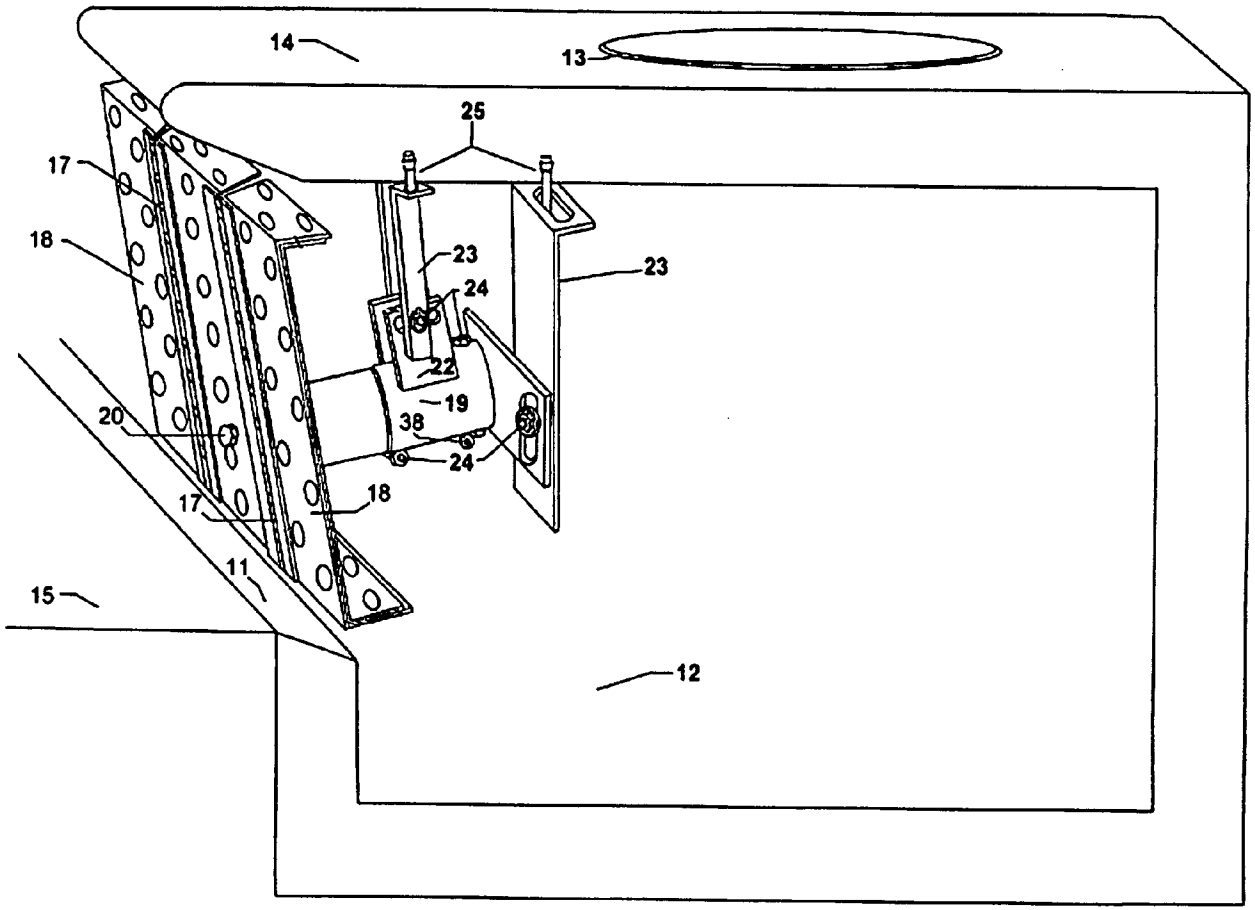
FIG. 10 is a schematic diagram depicting the example curb-opening retractable screen system from the right side view with the winged screens in a closed position, according to some embodiments.

FIG. 7 is a schematic diagram depicting the example curb-opening retractable screen system from the left side view with the winged screens 18 in a closed position. FIG. 8 is a schematic diagram depicting the example curb-opening retractable screen system from the left side view with the winged screens 18 in an open position. FIG. 9 is a schematic diagram depicting the example curb-opening retractable screen system from the right side view with the winged screens 18 in an open position. FIG. 10 is a schematic diagram depicting the example curb-opening retractable screen system from the right side view with the winged screens 18 in a closed position.

Figure 15:
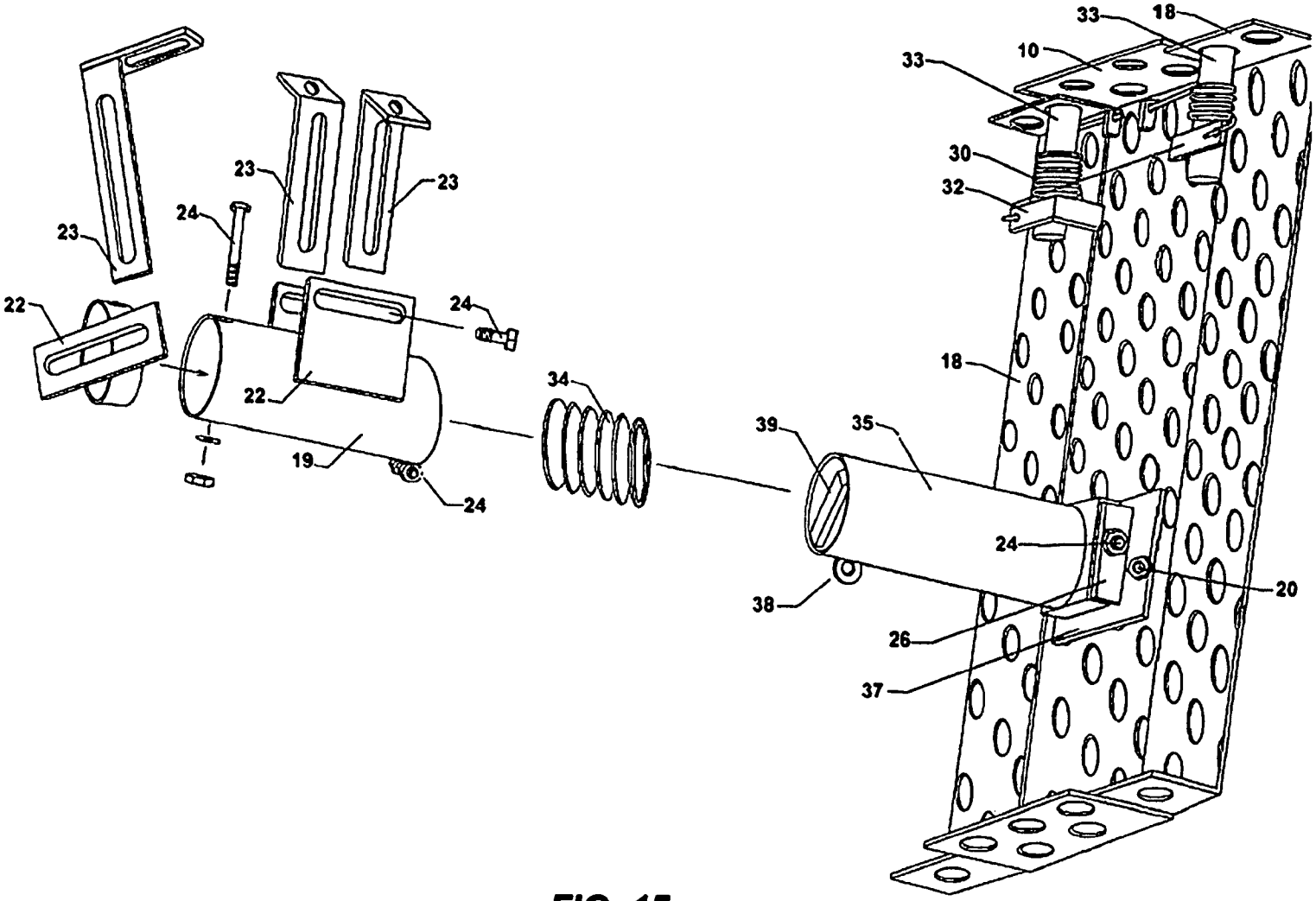
FIG. 15 is a schematic diagram depicting an example unassembled curb-opening retractable screen system, according to some embodiments.

In FIGS. 7-10, winged screens 18 connects with a center screen 10 using piano hinge 17. One or more cap screws 20 secures the center screen 10 to mounting plate 26 (as shown in FIG. 15), wherein one or more cap screws and nuts secures the screen assembly to traveling tube 35 and traveling tube 19, which may allow the screen system to move backward into the catch basin 12 away from the curb opening 11. The winged screens 18 have springs 30 that are attached to spring holder tubes 33, as shown in FIGS. 5 and 6. One side of spring 30 may be placed near the hinge 17 onto the center screen 10, and the other end of the spring may be placed near the hinge 17 onto the winged screen 18. The spring tension may be set to allow the winged screens 18 to open at a predetermined storm water curb flow rate. In some embodiments, the spring tension may be set to allow medium to high curb water flow. Referring to FIGS. 7 and 10, the retractable screen system may be closed, whereas in FIGS. 8 and 9, the coil spring 34 (as shown in FIG. 15) within traveling tube 19 may be at a minimum or compressed length for maximum storm water flow capacity into the storm water catch basin 12 (e.g., maximum open position during a major storm water event). Anchor 25 may be any suitable component that may be used to secure bracket 23 to the catch basin wall, such as a concrete anchor cap screw. Washer 38 may be any suitable component that may be used to keep traveling tube 19 on track to slide in and out of tube 35 without little to no wobbling effect.

Figure 11:
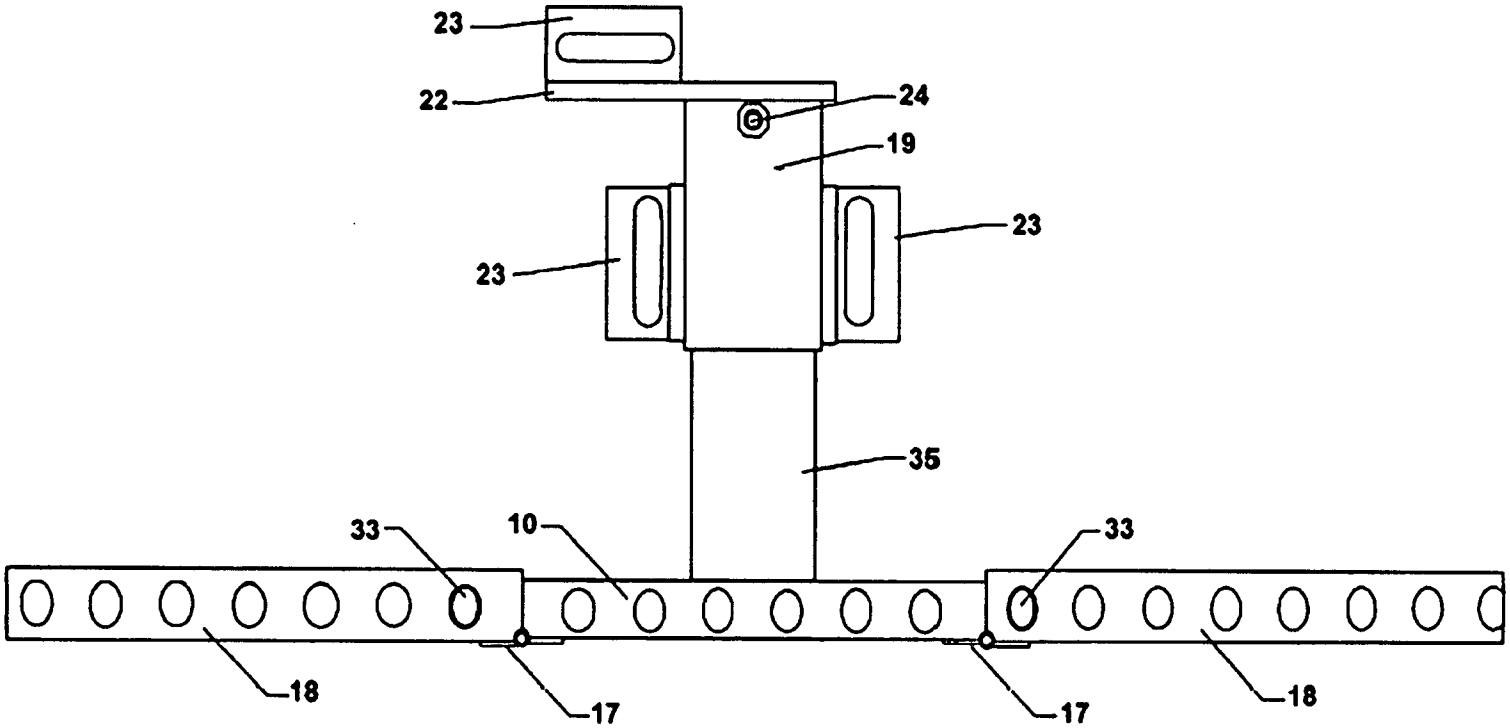
FIG. 11 is a schematic diagram depicting the example curb-opening retractable screen system from the top view with the winged screens in a closed position, according to some embodiments.
Figure 12:
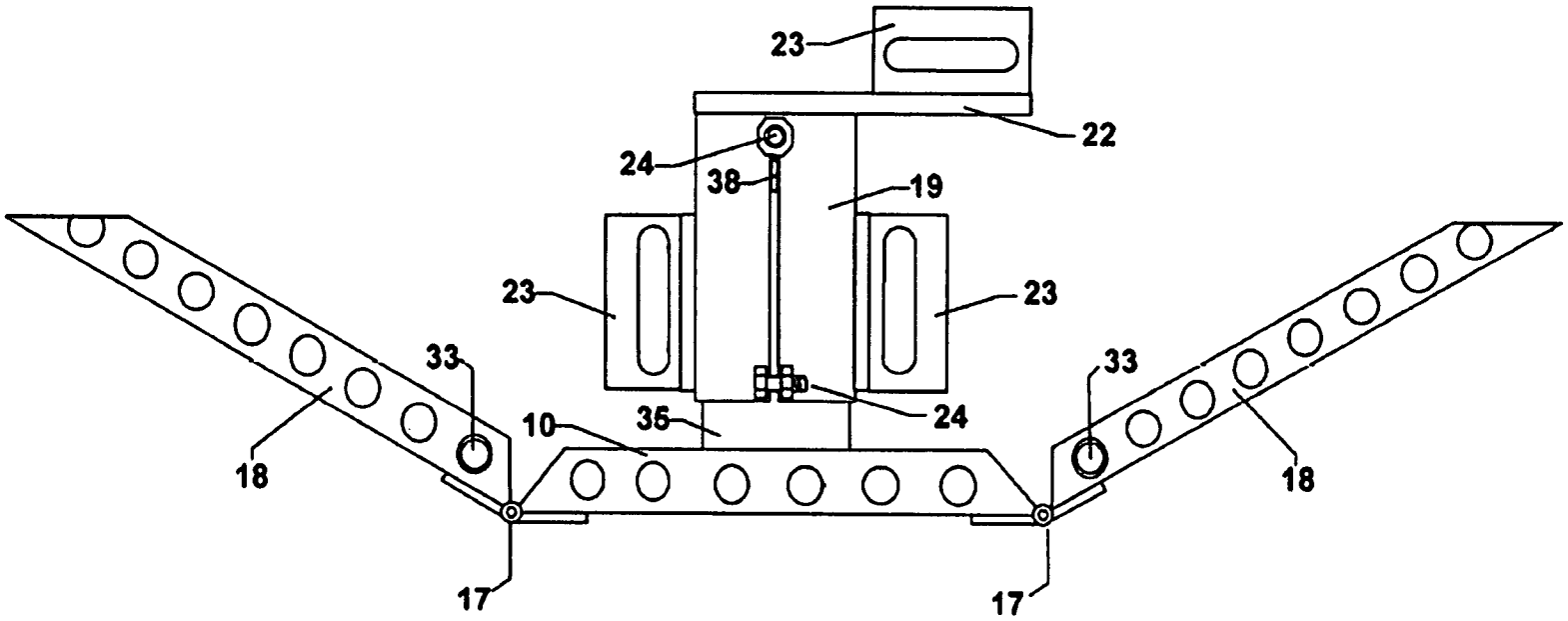
FIG. 12 is a schematic diagram depicting the example curb-opening retractable screen system from the bottom view with the winged screens in an open position, according to some embodiments.
Figure 13:
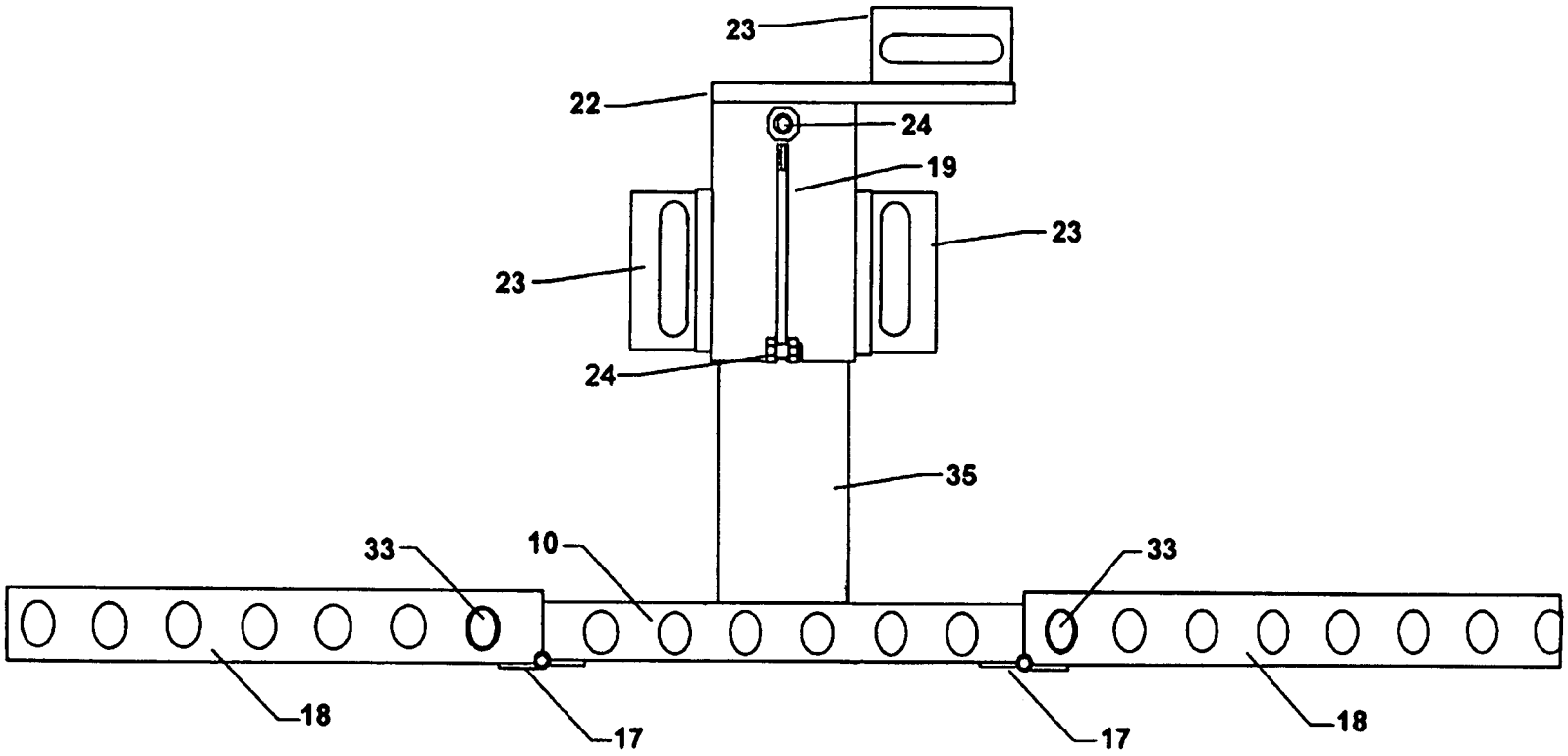
FIG. 13 is a schematic diagram depicting the example curb-opening retractable screen system from the bottom view with the winged screens in a closed position, according to some embodiments.
Figure 14:
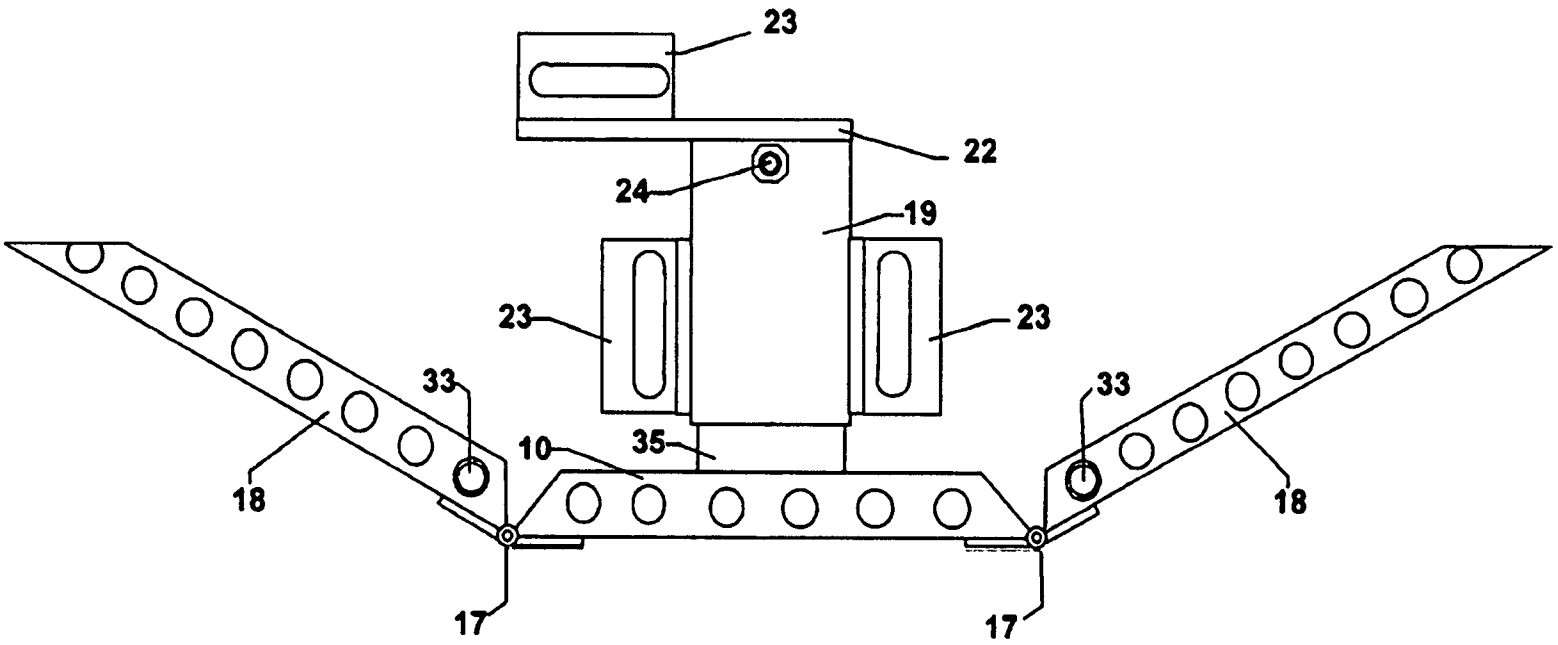
FIG. 14 is a schematic diagram depicting the example curb-opening retractable screen system from the top view with the winged screens in an open position, according to some embodiments.

FIG. 11 is a schematic diagram depicting the example curb-opening retractable screen system from the top view with the winged screens 18 in a closed position. FIG. 12 is a schematic diagram depicting the example curb-opening retractable screen system from the bottom view with the winged screens 18 in an open position. FIG. 13 is a schematic diagram depicting the example curb-opening retractable screen system from the bottom view with the winged screens 18 in a closed position. FIG. 14 is a schematic diagram depicting the example curb-opening retractable screen system from the top view with the winged screens 18 in an open position. The slotted stationary tube 19 contains a coil spring 34 which when fitted with tube 35, is kept from coming apart under compression by a cap screw and nut 24 which is secured (e.g., by weld) next to the slot end of tube 19.

FIG. 15 is a schematic diagram depicting an example unassembled curb-opening retractable screen system. A coil spring 34 may be set inside a spring mounting tube 19 that is slotted to hold a smaller tube 35 that has a guide 38 fitting into the slot in the mounting tube 19, allowing the spring to be compressed and decompressed such that the retractable screen system is able to open or close based on predetermined storm water flow rates. To hold the spring in place, a cap screw and nut 24 may be mounted (e.g., by weld) to the end of the slot on the mounting tube 19. The guide 38 may rest against the cap screw and nut 24, preventing the retractable screen system from exiting the slot.

The mounting tube 19 has adjustable mounting brackets 22 that may be secured (e.g., by weld) and may have additional adjustable positioning brackets 23 secured by cap screws 24 for mounting and securing the screens, mounting tube 19, and concrete wedge anchors 23 to the concrete ceiling, back wall, and/or side walls of the storm drain catch basin 12.

At the end of the tube 35 is a flat bar 39 of appropriate size (e.g., ½"×125"×2") that is secured (e.g., by weld) and may contain a spring compression stop. Mounted (e.g., by weld) at one end of tube 35 is a guide washer 38 of appropriate size (e.g., 5/16"), which may fit into the slot of tube 19, keeping the screens aligned into the curb opening 11 of the storm drain catch basin 12 during compression and decompression of spring 34, and/or opening and closing of the winged screens 18.

Two mounting brackets 22 are secured (e.g., by weld) to the spring holder tube 19, and one mounting bracket 22 is secured by a cap screw and nut 24 to the back of the spring holder tube 19. Attached to the mounting bracket 22 is an adjustable anchoring bracket 23, which allows adjustment to the screens inside the storm drain catch basin 12. Concrete wedge anchors 25 are inserted through the tops of the adjustable anchoring brackets and inserted into the ceiling, side walls, and/or back wall of the storm drain catch basin 12 to secure the embodiment of the technology.

The center screen 16 may be secured to the slider tube 35 by the screen mounting bracket 37, which is secured to the slider tube 35 (e.g., by weld). Inserted horizontally through the screen mounting bracket 37 is a cap screw and nut 24 that will secure the center screen 10 to the slider tube 35.

Figure 16:
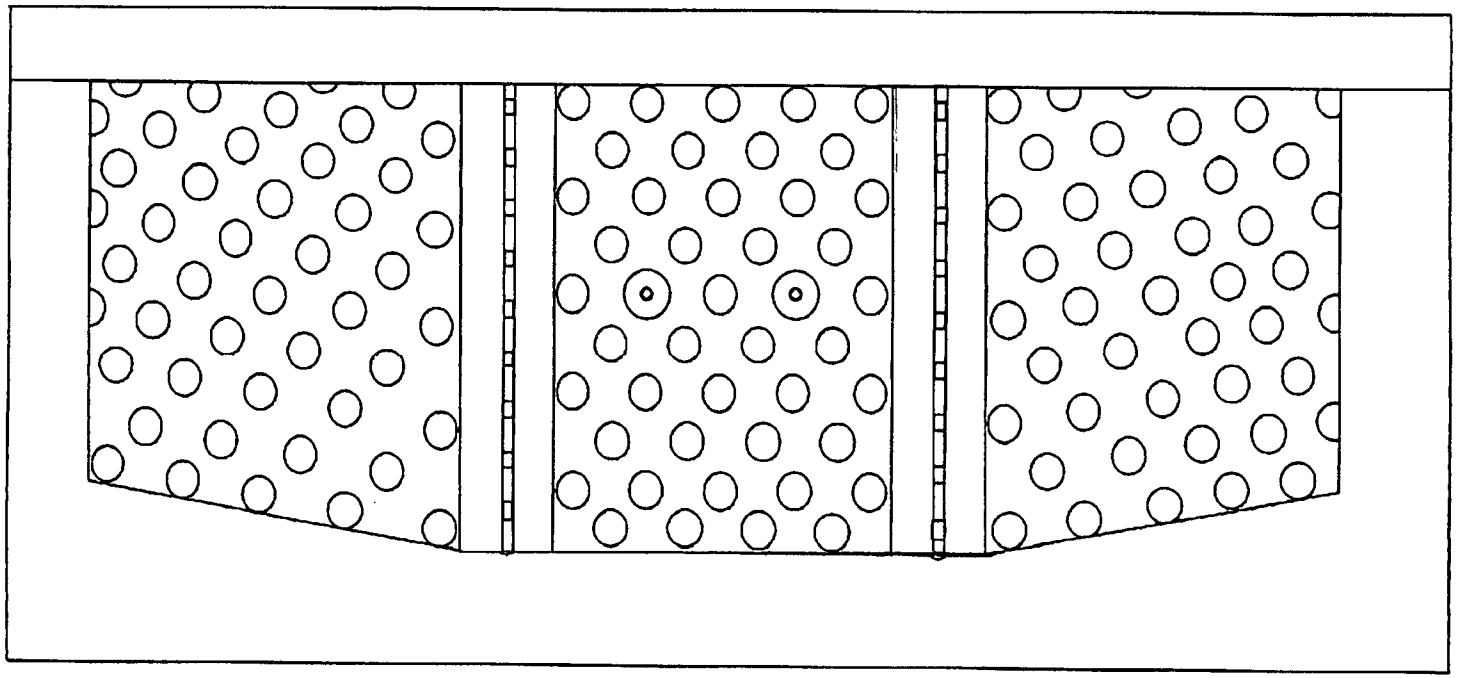
FIG. 16 is a schematic diagram depicting the example curb-opening retractable screen system from the front view with the winged screens in an open position, according to some embodiments.
Figure 17:
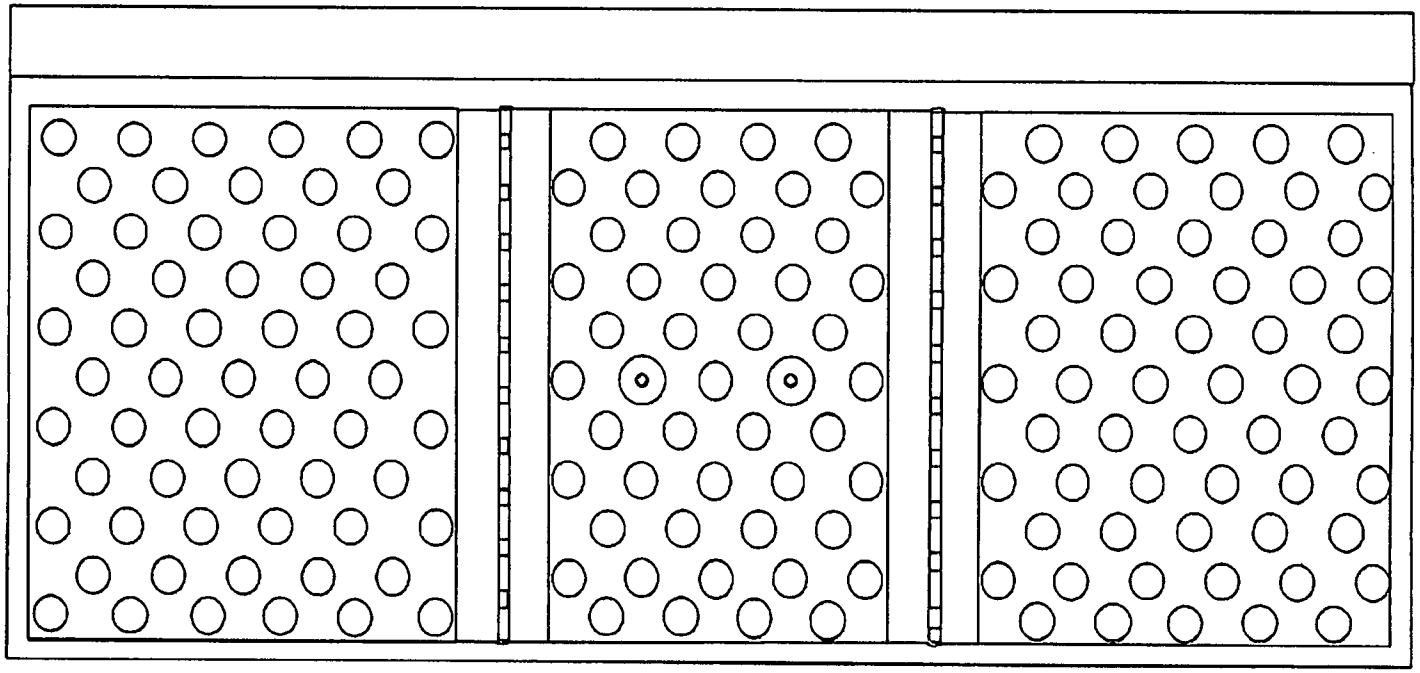
FIG. 17 is a schematic diagram depicting the example curb-opening retractable screen system from the front view with the winged screens in a closed position, according to some embodiments.

FIG. 16 is a schematic diagram depicting the example curb-opening retractable screen system from the front view with the winged screens 18 in an open position. FIG. 17 is a schematic diagram depicting the example curb-opening retractable screen system from the front view with the winged screens 18 in a closed position.

The winged screens 18 as well as the center screen 10 may remain closed when no fluids and/or low-flow fluids enter the screens (e.g., when the fluid flow rate is zero). As fluid begins to enter the system, the winged screens 18 open based upon the tension set for the spring loaded assembly. As the fluid rate increases, the winged screens 18 may accordingly open wider. The center screen spring may compress during extreme storm flow events to allow the retractable screen system to open (e.g., both the winged screens 18 and the center screen 10), preventing street flooding. When the fluid flow rate decreases, the winged screens 18 and center spring may accordingly begin to close. The retractable screen system may divert trash and/or debris from entering the storm drain catch basin 12 during zero to low fluid flow conditions (e.g., nuisance water flow from lawn watering). Trash and/or debris build-up in front of the retractable screen system may be collected by street sweeping trucks as they patrol their scheduled street routes.

Figure 18:
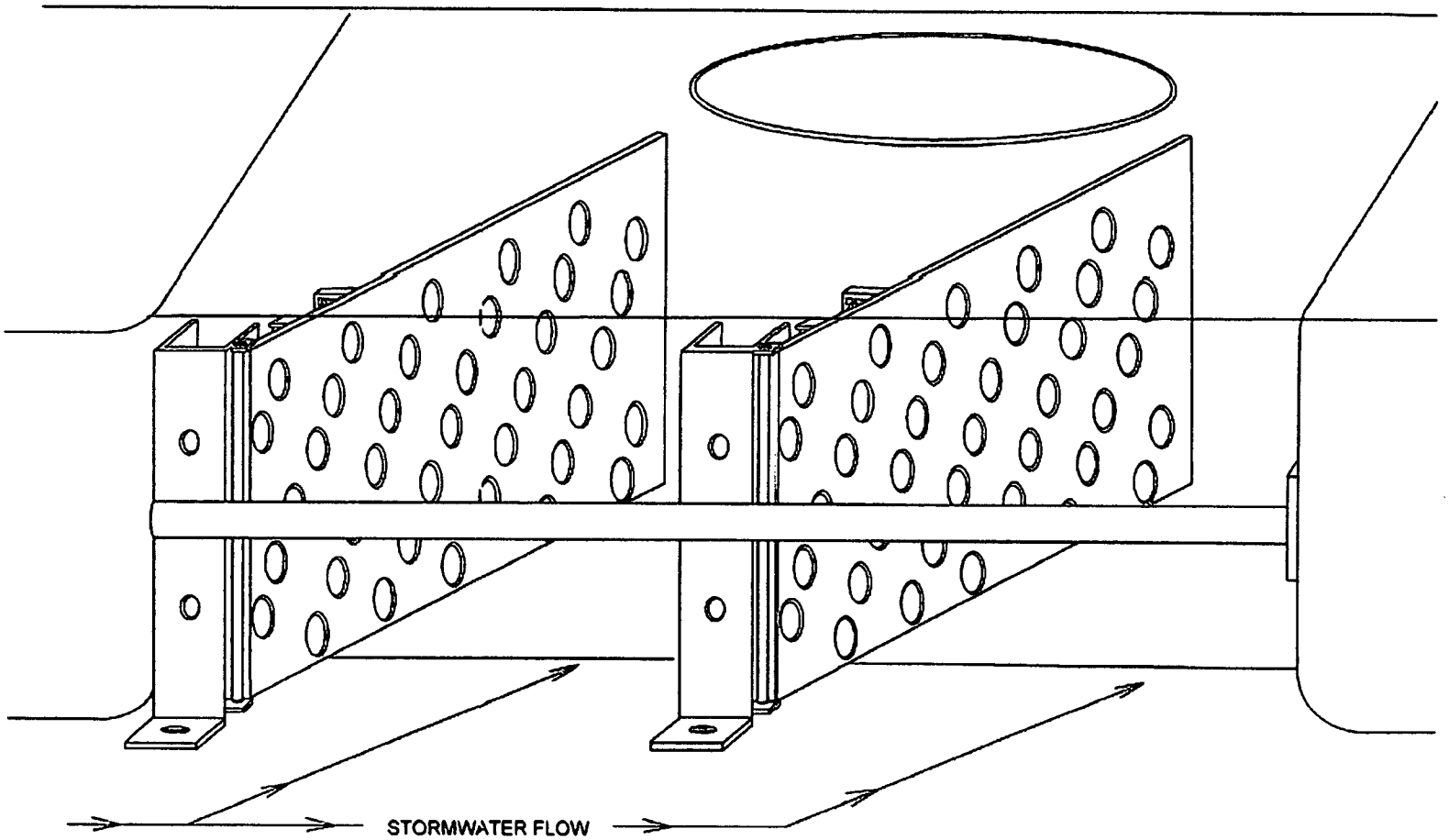
FIG. 18 is a schematic diagram depicting another example of a curb-opening retractable screen system, according to some embodiments.

FIG. 18 is a schematic diagram depicting another example of a curb-opening retractable screen system. As shown in FIG. 18, the winged screens may open in the same direction, which may be effective for streets that have an incline and/or decline. In some embodiments, the winged screens may open in unison.

While the embodiments are described with reference to various implementations and exploitations, it will be understood that these embodiments are illustrative and that the scope of the embodiments is not limited to them. Many variations, modifications, additions, and improvements are possible.

Plural instances may be provided for components, operations, or structures described herein as a single instance. Finally, boundaries between various components, operations, and structures are somewhat arbitrary, and particular operations are illustrated in the context of specific illustrative configurations. Other allocations of functionality are envisioned and may fall within the scope of the embodiment(s). In general, structures and functionality presented as separate components in the exemplary configurations may be implemented as a combined structure or component. Similarly, structures and functionality presented as a single component may be implemented as separate components. These and other variations, modifications, additions, and improvements fall within the scope of the embodiment(s).

What is claimed is:

1. An apparatus for use in an opening to a catch basin, comprising:

a retractable center screen;

a retracting spring-loaded tube assembly coupled to the retractable center screen and secured to a ceiling of the catch basin, the retracting spring-loaded tube assembly comprising:

a center spring within the retracting spring-loaded tube assembly, the center spring allowing the retractable center screen to open and close horizontally into the catch basin; and two independently-operating side screens each coupled to the retractable center screen by a side spring, each side screen being spring-loaded by the respective side spring such that each side screen is capable of opening and closing horizontally into the catch basin.

2. The apparatus of claim 1, wherein the retracting spring-loaded tube assembly is located higher than the retractable center screen.

3. The apparatus of claim 1, wherein the retractable center screen is capable of horizontally retracting into the catch basin based on a first predetermined fluid flow rate of fluid flowing into the catch basin.

4. The apparatus of claim 1, wherein the two independently-operating side screens are closed when a fluid flow rate of fluid flowing into the catch basin is substantially zero.

5. The apparatus of claim 1, wherein the two independently-operating side screens are capable of opening at an opening rate that is based on a second predetermined fluid flow rate of fluid flowing into the catch basin.

6. The apparatus of claim 1, wherein the two independently-operating side screens are capable of closing at a closing rate that is based on a second predetermined fluid flow rate of fluid flowing into the catch basin.

7. The apparatus of claim 1, wherein the two independently-operating side screens are capable of opening in opposite directions.

8. The apparatus of claim 1, wherein the two independently-operating side screens are capable of opening in the same direction.

9. The apparatus of claim 1, further comprising:

a first spring coupled to a first side screen of the two independently-operating side screens, the first spring directly causing the first side screen to open and close horizontally into the catch basin; and a second spring coupled to a second side screen of the two independently-operating side screens, the second spring directly causing the second side screen to open and close horizontally into the catch basin.

* * * * *